US005924471A

United States Patent [19]

Lund et al.

[11] Patent Number: 5,924,471

[45] Date of Patent: Jul. 20, 1999

[54] METHOD OF FABRICATING LEAD BUSHINGS AND BATTERIES USING SAME

[75] Inventors: David L. Lund, Minneapolis; William H. Kump, West St. Paul, both of Minn.

[73] Assignee: GNB Technologies, Inc., Mendota Heights, Minn.

[21] Appl. No.: 08/903,179

[22] Filed: Jul. 30, 1997

[51] Int. Cl.[6] ..... B22D 35/00

[52] U.S. Cl. ..... 164/133; 164/337; 222/593

[58] Field of Search ..... 164/133, 337; 222/592, 593, 594

[56] References Cited

U.S. PATENT DOCUMENTS

| | | | |
|---|---|---|---|
| 3,395,748 | 8/1968 | Tiegel | 164/103 |
| 3,718,174 | 2/1973 | Hull et al. | 164/154 |
| 3,802,488 | 4/1974 | Hull et al. | 164/270 |
| 4,108,417 | 8/1978 | Simonton et al. | 249/81 |
| 4,158,382 | 6/1979 | Oxenreider et al. | 164/305 |
| 4,284,122 | 8/1981 | Oxenreider et al. | 164/98 |
| 4,377,197 | 3/1983 | Oxenreider et al. | 164/112 |
| 4,635,706 | 1/1987 | Behrens | 164/500 |
| 4,977,946 | 12/1990 | Borrousch et al. | 164/57.1 |
| 5,022,457 | 6/1991 | Iwamoto et al. | 164/155 |
| 5,040,589 | 8/1991 | Bradley et al. | 164/312 |
| 5,088,546 | 2/1992 | Greanias et al. | 164/255 |
| 5,170,835 | 12/1992 | Eberle et al. | 164/108 |
| 5,657,812 | 8/1997 | Walter, et al. | 164/133 |

*Primary Examiner*—Kuang Y. Lin
*Attorney, Agent, or Firm*—Leydig, Voit & Mayer, Ltd.

[57] ABSTRACT

A method for fabricating bushings for lead-acid cells or batteries is provided which is amenable to automation and control and provides relatively porosity-free bushings comprising utilizing a mold having a cavity in the configuration of the bushing desired and a lead fill unit comprising a lead pot with the molten lead alloy for the bushing and a heated fill line and/or heated fill block wherein the mold and lead fill units are moved into alignment, heating such as induction heating to cause the solidified molten alloy at the end of the heated fill line or in the heated fill block orifice to become molten, gravity filling the mold and then moving the mold and lead fill unit out of alignment, the bushing preferably being cast in an upside-down orientation so as to minimize gas entrainment and/or particulate contamination.

7 Claims, 3 Drawing Sheets

METHOD OF FABRICATING LEAD BUSHINGS AND BATTERIES USING SAME

FIELD OF THE INVENTION

This invention relates to lead-acid batteries and, more particularly, to a method of fabricating bushings used in such batteries.

BACKGROUND OF THE INVENTION

Lead-acid cells and batteries utilize electrical connectors, most typically termed "bushings," to, in general, electrically connect various parts of the battery. Such bushings have a variety of configurations. However, one principal criteria is that the bushing be capable of efficiently conducting the current generated by the cell or battery.

One illustrative application for a bushing is in forming a terminal. More particularly, by way of one example, a bushing, typically embedded in the plastic cover, is generally annular in shape and is complementally sized to accept an upstanding post extending out of the cover in the terminal cell. In some applications, the bushing and post are then fused together to effect the electrical connection. In other applications, while the bushing and post are fused together, the terminal is offset from the annular opening of the bushing and is an integral part of the bushing.

In fabricating such bushings in the lead-acid battery field, a variety of techniques have been proposed. More particularly, the use of die casting and manual or automated gravity casting have been considered and used.

However, collectively, none of the methods previously used are entirely satisfactory. Indeed, a variety of problems exist.

Such problems range from the relative expense of equipment and/or molds to product issues such as gas entrainment in the resulting bushing. Such gas entrainment can lead to less than optimum electrical connections due to the increased electrical resistance which results. Even further, gas entrainment, and the resultant porosity in the molded bushing, can cause undesirable lead sputtering during subsequent fusion operations as well as enhancing potential electrolyte leakage problems.

Still further, prior methods raise a range of process-related issues. Such issues range from relatively high process expertise required when manual gravity casting techniques are used to drossing and lead-in-air problems.

An extremely important process issue concerns avoiding clogged valves and lines. More particularly, prior methods for making bushings have been plagued with problems due to clogged valves and lines due to solidified lead. After casting the bushing with the required quantity of lead or lead alloy, the lead supply must be cut off, typically by a valve. It has proven quite difficult to maintain such valves and the associated lines free from solidified lead.

Accordingly, despite the fact that a variety of casting techniques have been used over many years and the problems have, at least in general, been recognized, no satisfactory fabricating technique has been developed. There accordingly exists a need for a method of fabricating bushings which can minimize, if not eliminate, the problems attendant with prior techniques.

It is accordingly an object of the present invention to provide a more effective and efficient method for fabricating lead bushings for lead-acid cells and batteries.

Another object of this invention is to provide bushings and lead-acid cells and batteries utilizing such bushings which are less susceptible to gas entrainment and provide more effective electrical connections.

Yet another object of this invention lies in the provision of a method for fabricating such bushings which minimizes the need for process expertise and is more amenable to automation.

A still further and important object of the present invention provides a method for fabricating bushings which minimizes problems due to solidified lead. A related and more specific object provides a method that eliminates the need for using conventional valves.

Other objects and advantages of the present invention will be apparent as the following description proceeds.

SUMMARY OF THE INVENTION

In accordance with the present invention, a method of fabricating lead bushings for lead-acid cells and batteries is provided which combines a gravity mold fill with induction heating to provide an effective fabrication system. The resulting bushings allow highly effective electrical connections to be made due to minimal gas entrainment. This fabrication method is amenable to automation so that manual process expertise is minimized. Pursuant to an important aspect of this invention, issues relating to clogged valves and lines are eliminated by employing, in effect, thermal valves. A more preferred embodiment utilizes unique mold positioning so as to further minimize gas entrainment.

DETAILED DESCRIPTION OF THE INVENTION

Figure 1:
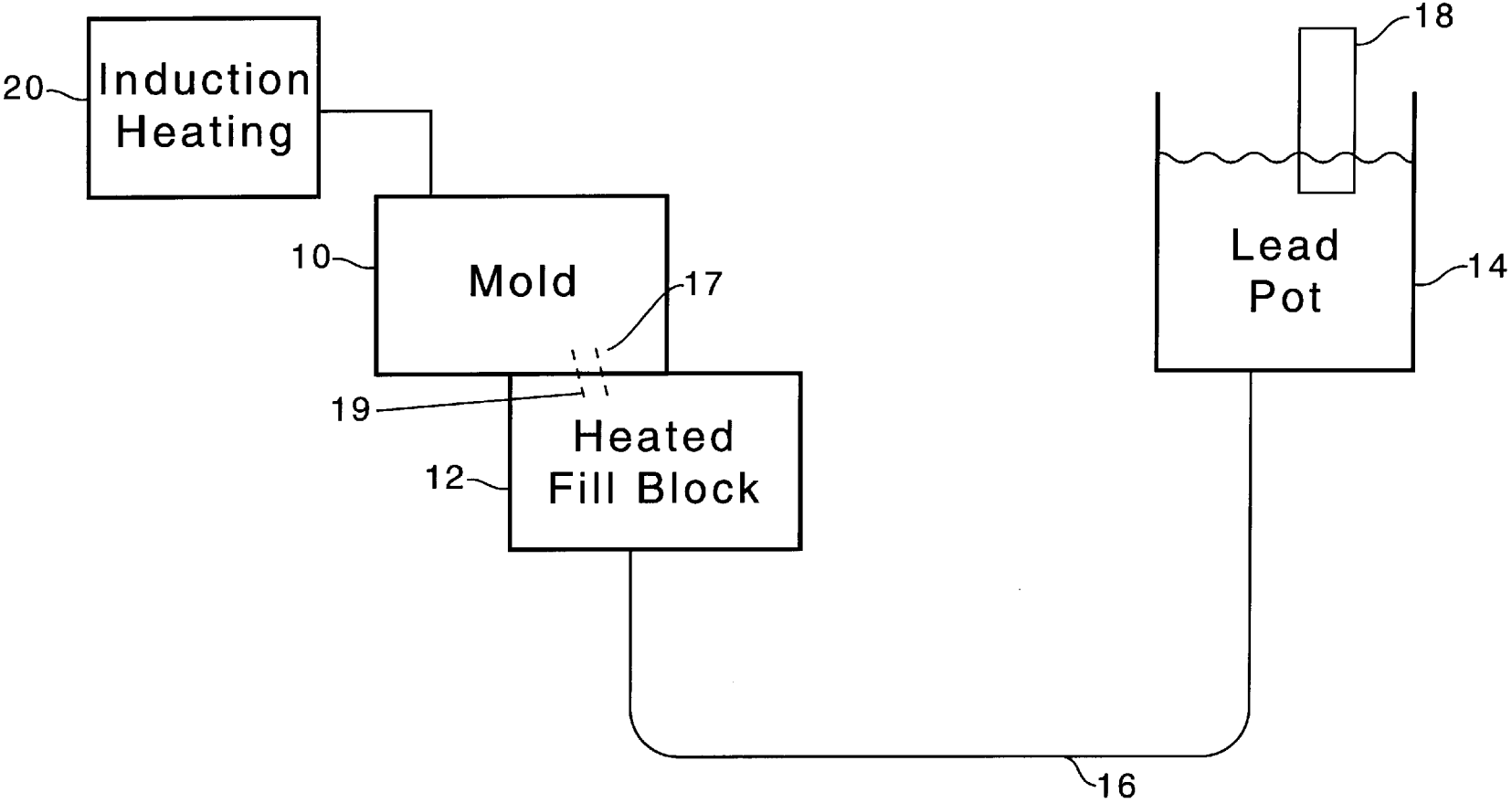
FIG. 1 is a schematic showing in block form the fabrication method of the present invention.

While the invention is susceptible of various modifications and alternative constructions, certain illustrative embodiments thereof have been shown in the drawings and will be described below in detail. It should be understood, however, that there is no intention to limit the invention to the specific forms disclosed, but, on the contrary, the intention is to cover all modifications, alternative constructions and equivalents falling within the spirit and scope of the invention.

Thus, while the present invention will be described principally in conjunction with bushings for lead-acid cells and batteries, it should be appreciated that the present invention is equally applicable to fabricating any other small parts wherein the desire is to increase automation, reduce the necessary process expertise required, eliminate the need for using conventional valves, or reduce gas entrainment in the fabricated part.

Further, while the present invention is particularly useful for fabricating bushings and the like having a portion of a part where porosity and gas entrainment need to be minimized, the present invention is not so limited. Similarly, the present invention is not limited to any particular configuration for the bushing, nor is the invention limited to the exemplary bushing shown in the drawings. Indeed, even in the case of a bushing used to form the terminal post, there are many variations as hereinbefore mentioned. For example, instead of the embodiment illustrated in which the bushing and post are fused together to provide the terminal for the cell or battery, other bushing configurations have an integral offset terminal, the post being fused to the bushing to provide the electrical connection to the offset terminal.

Pursuant to a principal aspect of the present invention, the bushing mold is filled from the bottom of the mold using a gravity fill so that, as the lead level rises in the mold, the filling of the mold proceeds relatively slowly, minimizing any gas entrainment. To this end, as is shown in FIG. 1, a mold 10 is provided having a mold cavity in the shape of the desired bushing. Suitable molds are known. Heated fill block 12 is provided with molten lead serving as a reservoir for supplying the requisite molten lead for forming the bushing as will be described hereinafter.

Molten lead to heated fill block 12 is provided from a molten lead pot 14 via feed line 16. Plunger 18 serves to adjust the level of molten lead in lead pot 14 and assist in filling mold 10.

Still further, in accordance with the embodiment of the present invention shown in FIG. 1, the casting operation comprises first aligning the mold 10 with the lead fill unit comprising the lead pot 14, heated fill block 12 and line 16. This can be accomplished by either moving the mold 10 into alignment or by moving the lead fill unit, each movement being in the X-Y direction. In either event, what is brought into alignment are the orifice in the bottom of mold 10 and the connecting orifice in heated fill block 12, these being shown by dotted lines in FIG. 1 and being designated, respectively, 17 and 19.

After the mold 10 and the lead fill unit are aligned, then the mold 10 can be gravity filled by any means desired. Thus, one satisfactory method involves adjusting the elevation of lead pot 14 so that it is at the level of mold 10. Then, by utilizing a plunger 18 having a mass generally the same as that of the bushing being molded, the molten lead alloy head pressure will be held constant as the mold 10 fills when the plunger 18 is submersed in the molten alloy in the lead pot 14.

Alternatively, a sensor could be used to determine the height of the molten lead alloy in lead pot 14 and to add molten alloy to provide whatever head pressure is desired. Added lead alloy could be supplied from a large reservoir of molten lead alloy (not shown herein), such large reservoirs being known and conventionally used in the lead-acid battery industry.

As may thus be appreciated, while the size of the lead pot 14 can be varied as desired, it will be more desirable to utilize a pot having a relatively small capacity particularly when the lead fill unit is what is moved into and out of alignment with mold 10.

Still further, if desired from a perceived safety standpoint or the like, the lead pot 14 could also be positioned below the elevation of the mold 10. In this embodiment, no molten lead alloy could exit the lead fill unit until activation. Such activation could be effected by any means so as to allow the desired gravity feed to result, as by using a suitable sized plunger to generate the desired head pressure.

One important aspect of the present invention turns a problem into a solution. Thus, as has been previously generally referenced, clogged lines and valves have been a problem in molding operations of this type. Indeed, it is extremely difficult, if not impossible, to prevent quiescent molten lead alloy from solidifying when exposed to ambient conditions. Accordingly, when filling is not taking place, orifice and line 19 in heated fill block 12 will be blocked by solidified molten lead alloy in a relatively short period of time.

In accordance with a principal aspect of the present invention, such solidified molten lead alloy is used as a thermal valve. When filling is not taking place, this thermal valve quickly closes without any external means required to effect this result. When it is desired to initiate filling, then the thermal valve is opened by heating appropriate to cause the solidified lead alloy to become molten. No other valves are needed.

Another principal aspect of the preferred embodiment of this invention utilizes induction heating to control the thermal valve in the system and to enhance the quality of the bushing being fabricated. More particularly, when the mold and lead fill units are in alignment, mold 10 is heated via induction heating. In typically less than a second or so, the thermal valve formed by the solidified lead alloy is, in effect, opened as the solidified lead becomes molten. This allows the supply of the lead alloy necessary to fill the mold.

Utilizing induction heating for mold 10 during filling inherently creates internal mixing and vibration of the rising lead alloy in the bushing mold, thereby assisting gravity to raise air or gas entrainment and/or particulate contamination toward the top of mold 10. In this fashion, the desired porosity and quality of the bushing being cast are desirably effected.

After the mold is filled, the induction heating can be terminated. The molten lead quickly solidifies, forming the desired bushing. The mold 10 and the lead fill units are moved out of alignment, awaiting removal of the cast bushing and the next fill and casting operation.

As to the requirements of the various components used in this invention, the heated fill block 12 and line 16 need to be heated; and such heating can be accomplished by resistance heating. Suitable equipment is conventional.

Regarding plunger 18, if used to adjust the lead alloy level by controlled submersion, the plunger must be of a material inert and non-wetting at the temperatures used (e.g., up to 1,000° F. or so). One illustrative example of a useful material is titanium.

Concerning induction heating, this may be accomplished using conventional medium to low frequency induction heating equipment. Thus, the induction heating must penetrate the bushing mold cavity and the heated fill block so as to accomplish the functions hereinbefore discussed. Illustrative useful frequencies range from one to 50 kilocycles.

As to moving the mold 10 and/or the lead fill units, conventional techniques are known and may be used. For example, air cylinders or the like could be employed.

As may be appreciated, the present invention is highly amenable to automation. Thus, if desired, the operation of plunger 18, the movement of the mold 10 and/or the lead fill unit and the induction heating operation all can be computer-controlled. Even further, if economics would make this desirable, it is possible to utilize a plurality of molds so that the time involved in the cooling and stripping of the cast bushing become immaterial since other molds are used in the interim (viz., until the mold is ready for reuse).

Another embodiment of the present invention eliminates the heated fill block 12. In this embodiment, all of line 16 is heated except for the end which is adjacent the mold fill orifice 17 in the bottom of mold 10. The unheated end becomes the thermal valve in this embodiment. Induction heating can be used to not only heat mold 10 but the unheated end forming the thermal valve as well. Other heating means, although probably not as efficient (e.g., a cartridge heater), could be used for heating the unheated end as well. In this embodiment, if desired, the end of the fill line which serves as the thermal valve can be configured to enhance solidification of the lead alloy, as by forming the end with radial fins or the like.

A still further aspect of the present invention lies in utilizing the mold cavity in the most preferred embodiment such that the bushing is cast upside down. More particularly, pursuant to this aspect of the present invention, the more critical portion of the bushing, as will be more fully discussed hereinafter, is located closest to heated fill block 12. Accordingly, by casting the bushing "upside down," even if gas entrainment or particulate contamination results, such entrainment or contamination will be largely, if not essentially all, confined to the part of the bushing which is less critical.

Figure 2:
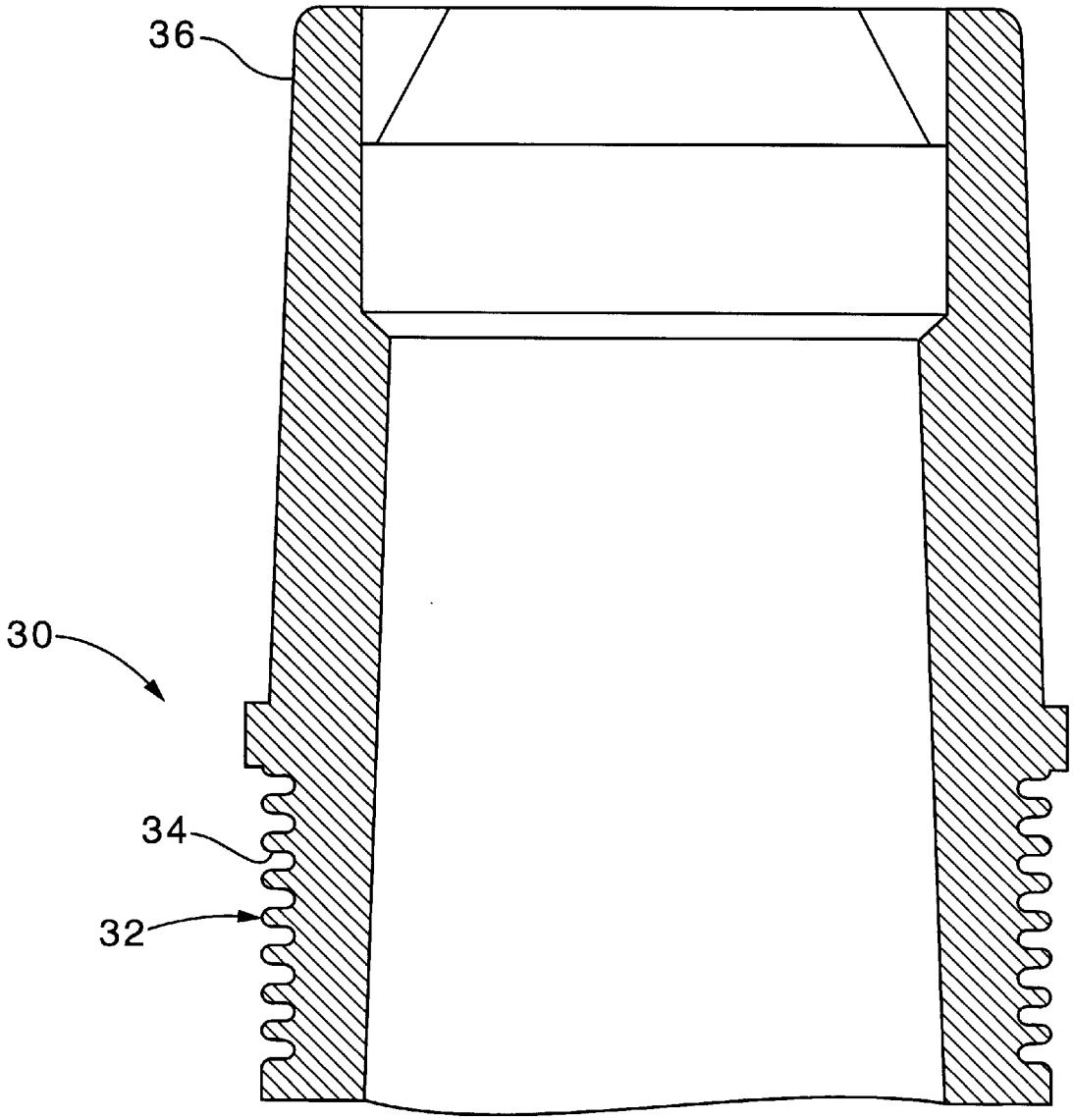
FIG. 2 is a cross-section view of an illustrative embodiment of a bushing which can be fabricated using the present invention.

More particularly, as is shown in FIG. 2, a bushing 30 comprises an annular body having a lower portion 32 having a series of circumferential acid rings 34 about this bottom portion 32. Such acid rings 34 are commonly utilized to enhance sealing between a plastic battery cover and the bushing, as well as to increase the electrolyte creepage path out of the battery so as to minimize electrolyte leakage. The top section 36 of bushing 30 is the more critical area of the bushing 30 since this is the part, in this configuration, which is fused to a post in the terminal cell to form the terminal. Thus, the fused terminal needs to be as free from gas entrainment or the like as is possible. Accordingly, pursuant to the most preferred aspect of the present invention, by utilizing a bottom fill and by molding the bushing upside down from the orientation shown in FIG. 2, top area 36 is closest to heated fill block 12 and is thus filled first as the level of molten lead rises in the mold. Thus, there is the greater likelihood that any gas entrainment will be thereby minimized.

The lead alloys used to form the bushing may be any of those conventionally used for this purpose. Various lead-based alloys with alloying elements such as tin and antimony, for example, are known and may be employed.

Figure 3:
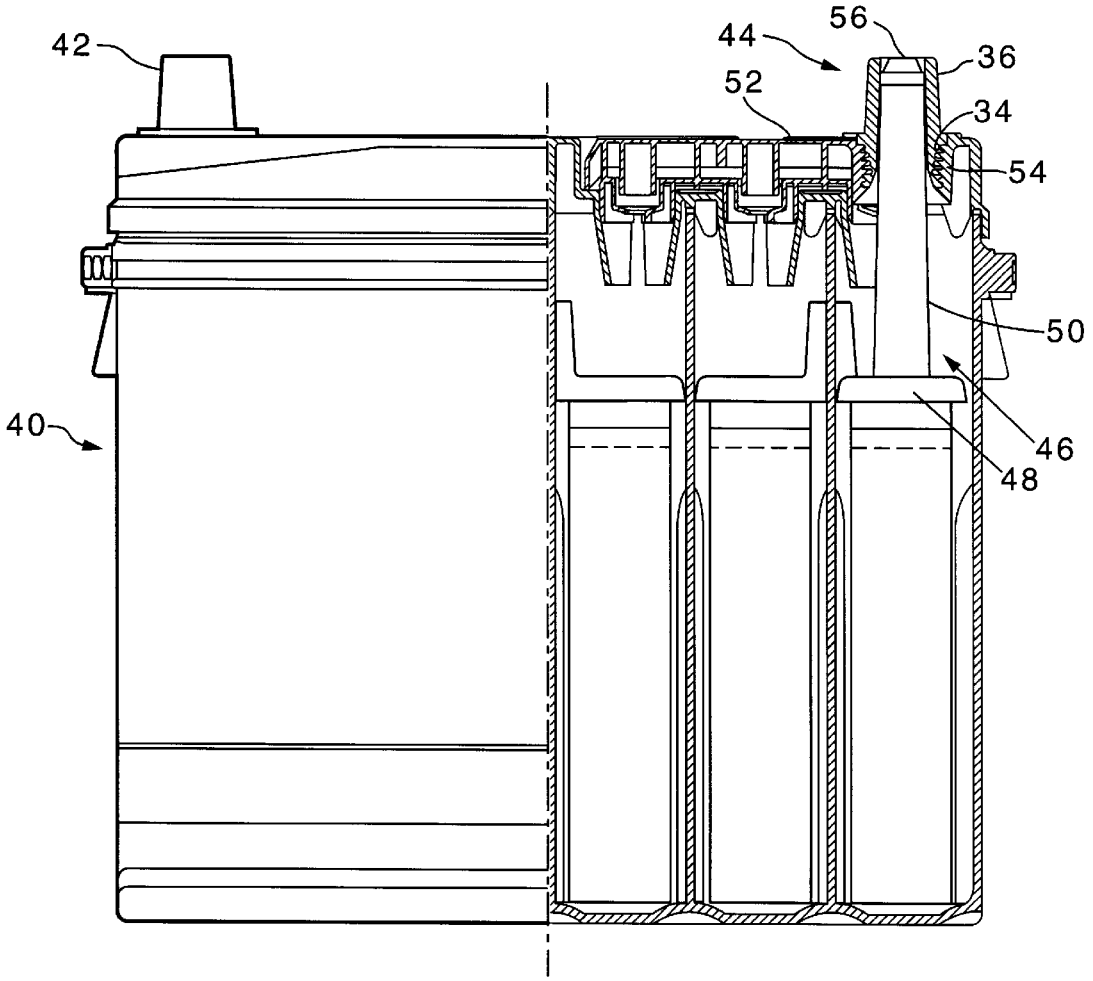
FIG. 3 is a side elevation view of an illustrative battery utilizing a bushing made in accordance with this invention, with the cover and side being partially broken away to show the bushing and terminal post.

FIG. 3 shows an exemplary battery 40 having a positive terminal 42 and a negative terminal shown generally at 44. The negative plates in terminal cell 46 are connected to strap 48 and upstanding post 50.

Bushing 30 is molded into cover 52 with portion 32 extending into terminal cell 46 and acid rings 34 being molded into the cover barrel 54. Upstanding portion 36 of bushing 30 receives post 50.

To form the terminal 44, portion 36 of bushing 30 is fused to the top part 56 of post 50. This is accomplished by induction heating or by other means which cause the respective surfaces to fuse together. Typically, the depth of the fusion only goes down to from about 3/16 to about 3/8 inch. It is this fused depth in which the quality of the bushing and the relative freedom from gas entrainment and particulate contamination is critical so as to optimize electrical efficiency.

Thus, as has been seen, the present invention provides an efficient method for fabricating bushings which is both readily amenable to automation and is relatively free from process problems. Further, in the most preferred embodiments, gas entrainment and particulate contamination, particularly in the more critical part of the bushing necessary for optimized electrical efficiency, are minimized, if not eliminated. The need for conventional valves is eliminated, replaced by a unique system involving a novel thermal valve.

We claim:

1. A method for fabricating a bushing for a lead acid cell or battery having a configuration with a bottom area and a top area for fusing to provide an electrical connection which comprises providing a mold having a cavity with the desired bushing configuration and a bottom end having an orifice for filling the mold cavity, the mold cavity being such that said top area of the brushing being fabricated is located adjacent said orifice, gravity filling the mold cavity through the orifice with a molten lead alloy rising upwardly from the top area to the bottom are of the bushing, being fabricated while causing any air, gas, and/or particulate contamination to rise as the mold cavity fills, allowing the molten lead alloy to solidify after the mold cavity has been filled, and removing the bushing from the mold.

2. The method of claim 1 wherein the mold is heated during gravity filling by induction heating to create internal mixing and vibration of the rising lead alloy, thereby assisting in raising any air, gas, and/or particulate contamination toward the top of the mold.

3. A method of fabricating a bushing for a lead-acid cell or battery having a configuration with a bottom area and a top area for fusing to provide an electrical connection which comprises providing a mold having a cavity with the desired bushing configuration and a bottom end having an orifice for filling the mold cavity, the mold cavity being such that said top area of the bushing being fabricated is located adjacent said orifice, providing a lead fill unit comprising a lead pot having molten lead alloy for filling the mold cavity and a heated fill line having an end for aligning with the mold orifice, and serving as a thermal valve being in a closed position by molten lead alloy being solidified when the lead contained in the line is in a quiescent state, moving the mold and lead fill unit into alignment, applying heat to open the thermal valve by causing the solidified lead alloy to become molten, gravity filling the mold cavity from the top area to the bottom area of the bushing being fabricated while causing any air, gas and/or particulate contamination to rise as the mold cavity fills, and then moving the mold and lead fill unit out of alignment after the mold cavity has been filled, the thermal valve reverting to a closed position.

4. The method of claim 3 wherein said heating is by induction heating.

5. The method of claim 3 wherein the bottom area of the bushing configuration has acid rings.

6. The method of claim 3 wherein said lead pot and said mold are at a common elevation so as to provide a constant head pressure for the molten lead alloy.

7. A method of fabricating a bushing for a lead-acid cell or battery having a configuration with a bottom area and a top area for fusing to provide an electrical connection which comprises providing a mold having a cavity with the desired bushing configuration and an orifice in the bottom of the mold, the mold cavity being such that said top area of the bushing being fabricated is located adjacent said orifice providing a lead fill unit comprising a lead pot with molten lead alloy for filling the mold cavity, a heated fill block and a heated fill line connecting said lead pot with said heated fill block, said heated fill block having an orifice and a line for connection with the bottom orifice of the mold for filling the mold cavity, and the orifice in the heated fill block serving as a thermal valve and being in a closed position upon the solidification of molten lead alloy when said molten lead alloy therein is in a quiescent state, moving the mold and lead fill unit into alignment, applying heat to open the thermal valve, gravity filling the mold cavity from the top area to the bottom area of the bushing being fabricated while causing any air, gas and/or particulate contamination to rise as the mold cavity fills, and moving the mold and lead fill unit out of alignment after the mold cavity has been filled, the thermal valve reverting to the closed position.

* * * * *

UNITED STATES PATENT AND TRADEMARK OFFICE

CERTIFICATE OF CORRECTION

PATENT NO. : 5,924,471

DATED : July 20, 1999

INVENTOR(S) : David L. Lund, William H. Kump

It is certified that errors appear in the above-identified patent and that said Letters Patent is hereby corrected as shown below:

In Claim 1, column 6, line 12, "brushing" should read "bushing".

In Claim 1, column 6, line 15, "are" should read "area".

Signed and Sealed this

Eleventh Day of April, 2000

*Attest:*

*Attesting Officer*

Q. TODD DICKINSON

*Director of Patents and Trademarks*